US008970470B2

(12) United States Patent
Mito

(10) Patent No.: US 8,970,470 B2
(45) Date of Patent: Mar. 3, 2015

(54) DISPLAY APPARATUS AND CONTROL METHOD THEREOF

(75) Inventor: Koji Mito, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 241 days.

(21) Appl. No.: 13/470,751

(22) Filed: May 14, 2012

(65) Prior Publication Data

US 2012/0293565 A1 Nov. 22, 2012

(30) Foreign Application Priority Data

May 20, 2011 (JP) ..... 2011-113884

(51) Int. Cl.

| | |
|---|---|
| ***G09G 3/36*** | (2006.01) |
| ***G09G 5/10*** | (2006.01) |
| ***G09G 3/34*** | (2006.01) |

(52) U.S. Cl.

CPC ..... *G09G 3/3406* (2013.01); *G09G 5/10* (2013.01); *G09G 2320/064* (2013.01); *G09G 2320/0686* (2013.01); *G09G 2340/12* (2013.01); *G09G 2360/16* (2013.01); *G09G 2320/0646* (2013.01)

USPC ..... 345/102; 345/690

(58) Field of Classification Search

None

See application file for complete search history.

(56) References Cited

U.S. PATENT DOCUMENTS

| | | | | |
|---|---|---|---|---|
| 2009/0146941 | A1* | 6/2009 | Fujine et al. | 345/102 |
| 2011/0032272 | A1* | 2/2011 | Noritake | 345/629 |
| 2011/0148940 | A1* | 6/2011 | Byun et al. | 345/690 |
| 2011/0205256 | A1* | 8/2011 | Park et al. | 345/690 |
| 2012/0154459 | A1* | 6/2012 | Otoi et al. | 345/690 |

FOREIGN PATENT DOCUMENTS

| | | | |
|---|---|---|---|
| JP | 2005-321424 | | 11/2005 |
| JP | 2008-299191 | * | 12/2008 |
| JP | 2010-096857 | | 4/2010 |
| JP | WO2011/040084 | * | 4/2011 |
| JP | WO2011/470084 | * | 4/2011 |

* cited by examiner

*Primary Examiner* — Quan-Zhen Wang
*Assistant Examiner* — Chad Dicke
(74) *Attorney, Agent, or Firm* — Cowan, Liebowitz & Latman, P.C.

(57) ABSTRACT

A display apparatus comprises a display panel, a backlight having emission brightness levels adjustable for each of divided sections, a graphic image generating unit that generates a graphic image signal, a synthetic image generating unit that generates a synthetic image signal representing a synthetic image in which an image based on the graphic image signal is overlapped on the image based on the input image signal, and a control unit, wherein the control unit controls the emission brightness levels of the backlight of a plurality of divided sections containing a graphic image display region, where a graphic image based on the graphic image signal is displayed, to be uniform, and controls the emission brightness levels of the backlight of other divided sections based on the input image signal.

5 Claims, 11 Drawing Sheets

DISPLAY APPARATUS AND CONTROL METHOD THEREOF

BACKGROUND OF THE INVENTION

1. Field of the Invention

The present invention relates to a display apparatus and a control method thereof.

2. Description of the Related Art

Liquid crystal panels used in liquid crystal display apparatuses display images by changing the transmittance of light emitted from a backlight. One problem in liquid crystal display apparatuses is that poor reproduction of blacks is caused by leaking of light of the backlight from the liquid crystal panel.

Attention has been drawn to a technique which dynamically adjusts the emission brightness of the backlight in accordance with input image signals to deal with this problem in liquid crystal display apparatuses. With this technique, the reproduction of blacks can be improved by adjusting (lowering) the emission brightness of the entire backlight when the brightness level of an input image signal is low.

Liquid crystal display apparatuses typically include a function for displaying an OSD (On Screen Display) image such as a menu image. If, however, an OSD image is displayed with the emission brightness of the backlight being lowered in accordance with the input image signal as mentioned above, the OSD image will be displayed darkly, resulting in poor visibility of the OSD image.

Conventional techniques intended to solve such a problem include an image display apparatus proposed by Japanese Patent Application Laid-open No. 2005-321424, in which the emission brightness of the entire backlight is maintained at a certain level when an OSD image is displayed.

Another image display apparatus proposed by Japanese Patent Application Laid-open No. 2008-299191 controls the emission brightness of the entire backlight to be kept higher than a predetermined level when an OSD image is displayed.

SUMMARY OF THE INVENTION

LEDs (Light Emitting Diodes) have been employed in recent years as the light source of the backlight. Backlight systems using LEDs (LED backlight) include a direct LED backlight with LED arrays arranged on the backside of the liquid crystal panel. The characteristic feature of the direct LED backlight is that the emission brightness of the backlight can be changed locally. A known backlight control method (control system) utilizing such a feature include a method as the emission brightness of the backlight in sections is controlled in accordance with input image signals. This method is called local dimming. Better contrast ratios can be expected with local dimming as the emission brightness of the backlight is controlled in sections, as compared to controlling the emission brightness of the entire backlight.

In such backlight control by local dimming, too, there is a need to keep good visibility of the OSD image. However, the conventional techniques mentioned above assume that the emission brightness is adjusted for the entire backlight, and do not take local dimming backlight control into consideration. Therefore, an attempt to prevent deterioration of visibility of the OSD image with the use of the conventional techniques will reduce the high contrast effect achieved by the local dimming. More specifically, since the emission brightness of the entire backlight is maintained at a certain level during the display of the OSD image with the technique disclosed in Japanese Patent Application Laid-open No. 2005-321424, local dimming cannot be performed during the display of the OSD image.

With the technique disclosed in Japanese Patent Application Laid-open No. 2008-299191, since the minimum brightness is set for the entire backlight during the display of the OSD image, the high contrast effect by the local dimming is reduced when the OSD image is displayed.

The present invention provides a display apparatus capable of displaying graphic images with good visibility without compromising the advantage of higher contrast ratios achieved by local dimming, and a control method thereof.

The present invention in its first aspect provides a display apparatus displaying an image based on an input image signal, the apparatus comprising:

a display panel;

a backlight having emission brightness levels adjustable for each of a plurality of divided sections;

a graphic image generating unit that generates a graphic image signal;

a synthetic image generating unit that generates a synthetic image signal representing a synthetic image in which an image based on the graphic image signal is overlapped on the image based on the input image signal; and a control unit that controls the emission brightness levels of the backlight for each of the divided sections based on the input image signal and the graphic image signal, wherein the control unit controls the emission brightness levels of the backlight of a plurality of divided sections containing a graphic image display region, where a graphic image based on the graphic image signal is displayed, to be uniform, and controls the emission brightness levels of the backlight of other divided sections based on the input image signal.

The present invention in its second aspect provides a method of controlling a display apparatus including a display panel and a backlight having emission brightness levels adjustable for each of a plurality of divided sections, the method comprising:

a graphic image generating step of generating a graphic image signal;

a synthetic image generating step of generating a synthetic image signal representing a synthetic image in which an image based on the graphic image signal is overlapped on an image based on an input image signal; and a control step of controlling the emission brightness levels of the backlight for each of the divided sections based on the input image signal and the graphic image signal, wherein in the control step, the emission brightness levels of the backlight of a plurality of divided sections containing a region where a graphic image based on the graphic image signal is displayed are controlled to be uniform, and the emission brightness levels of the backlight of other divided sections are controlled based on the input image signal.

According to the present invention, graphic images can be displayed with good visibility without compromising the advantage of high contrast ratios achieved by local dimming.

Further features of the present invention will become apparent from the following description of exemplary embodiments with reference to the attached drawings.

DESCRIPTION OF THE EMBODIMENTS

Hereinafter, embodiments of the present invention will be described with reference to the drawings. Note, however, the present invention should not be limited to the following embodiments.

The liquid crystal display apparatus according to the following embodiment displays images based on input image signals. The liquid crystal display apparatus according to the following embodiment controls the backlight by local dimming. While a liquid crystal display apparatus is described as one example in the following embodiment, the present invention can also be applicable to display apparatuses having display panels other than liquid crystal panels and a backlight. For example, the present invention can be used in various apparatuses having other display panels and light source elements such as an organic EL display with a color filter system (that uses organic EL light emitting elements and color filters) .

Figure 2:
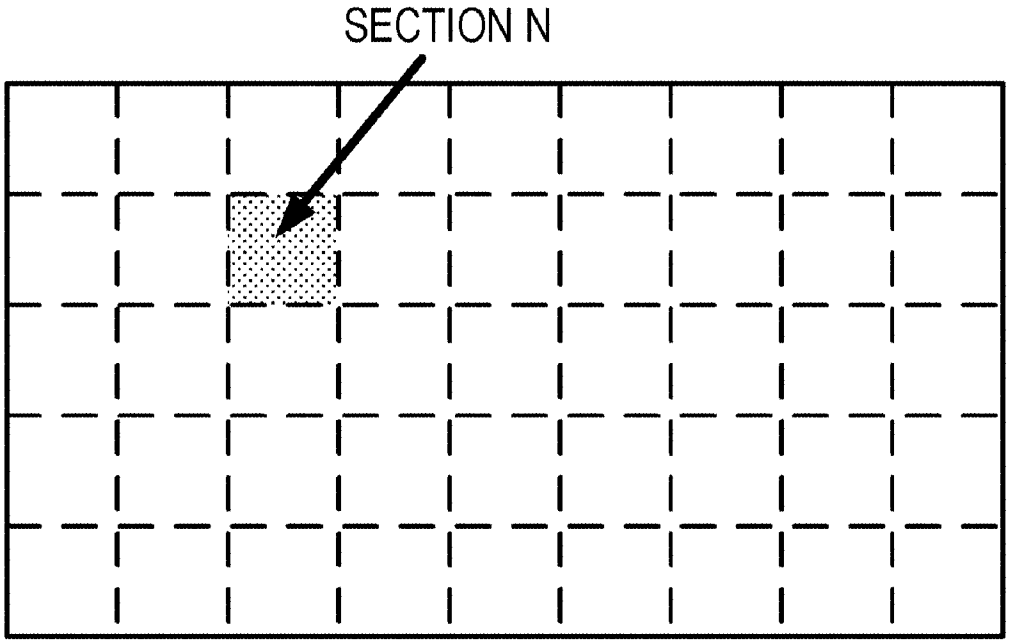
FIG. 2 is a diagram illustrating one example of a divided section.

Local dimming is a method of controlling the emission brightness of the backlight in clusters by dividing the screen region into a plurality of divided sections. In the following embodiment, one example will be described in which the screen region is split into 5×9=45 divided sections as shown in FIG. 2 and the emission brightness of the backlight is controlled for each of these divided sections. The number and the manner of dividing the screen are not limited to the above example. For example, the screen may be divided into a plurality of strip-like divided sections.

Embodiment 1

Hereinafter, a liquid crystal display apparatus according to Embodiment 1 of the present invention and a control method thereof will be described.

Figure 1:
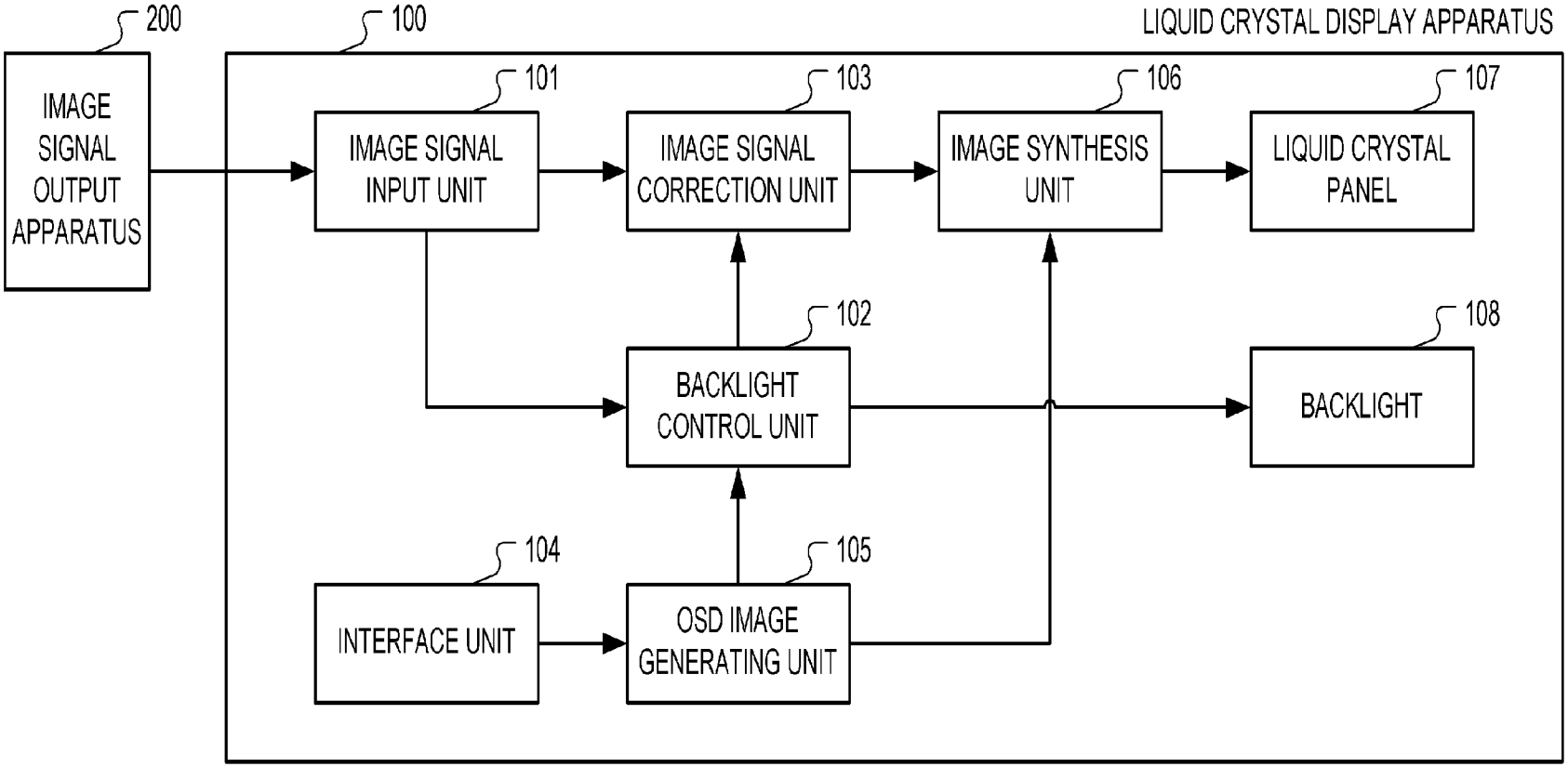
FIG. 1 is a block diagram illustrating one example of the functional configuration of a liquid crystal display apparatus according to Embodiment 1.

FIG. 1 is a block diagram illustrating one example of the functional configuration of a liquid crystal display apparatus 100 according to Embodiment 1. The liquid crystal display apparatus 100 displays images based on image signals input from an image signal output device 200. The liquid crystal display apparatus 100 controls the emission brightness of the backlight for each of the divided sections based on the image signals input from the image signal output device 200.

The image signal output device 200 inputs image signals to an image signal input unit 101. The image signal input unit 101 sends received signals (input image signals) to a backlight control unit 102 and an image signal correction unit 103 to be described later.

The backlight control unit 102 determines and controls the emission brightness of a backlight 108 to be described later for each of the divided sections based on the input image signals and image signals of OSD (On Screen Display) images (OSD image signals). The backlight control unit 102 will be described in more detail later with reference to the flowchart of FIG. 3.

The image signal correction unit 103 corrects the input image signals to compensate for changes in displayed brightness of respective pixels resulting from the changes in emission brightness of the backlight in accordance with the backlight brightness level determined by the backlight control unit 102.

An interface unit 104 receives a control signal requesting a display of an OSD image from a user interface such as a controller. This control signal is output from the user interface upon a user operating the user interface to display the OSD image. The interface unit 104 requests generation of an OSD image signal to an OSD image generating unit 105 in response to the received control signal.

The OSD image generating unit 105 generates an OSD image signal in accordance with the request from the interface unit 104. The OSD image generating unit 105 sends the generated OSD image signal to the backlight control unit 102 and to an image synthesis unit 106.

The image synthesis unit 106 generates a signal of a synthetic image having the OSD image overlapped on the image based on the input image signal. More specifically, the image synthesis unit 106 generates a synthetic image signal by synthesizing the OSD image signal generated by the OSD image generating unit 105 with the input image signal corrected by the image signal correction unit 103. The image synthesis unit 106 sends the generated synthetic image signal to a liquid crystal panel 107.

The liquid crystal panel 107 includes a plurality of liquid crystal elements and controls the light transmittance of each liquid crystal element based on the synthetic image signal generated by the image synthesis unit 106.

The backlight 108 includes LED arrays as the light source and irradiates light to the liquid crystal panel 107. The emission brightness of the backlight 108 can be adjusted in divided sections. The backlight 108 emits light at the backlight brightness level determined by the backlight control unit 102 for each of the divided sections.

As the light from the backlight 108 transmits the liquid crystal panel 107, an image is displayed on the screen of the liquid crystal display apparatus 100.

Figure 3:
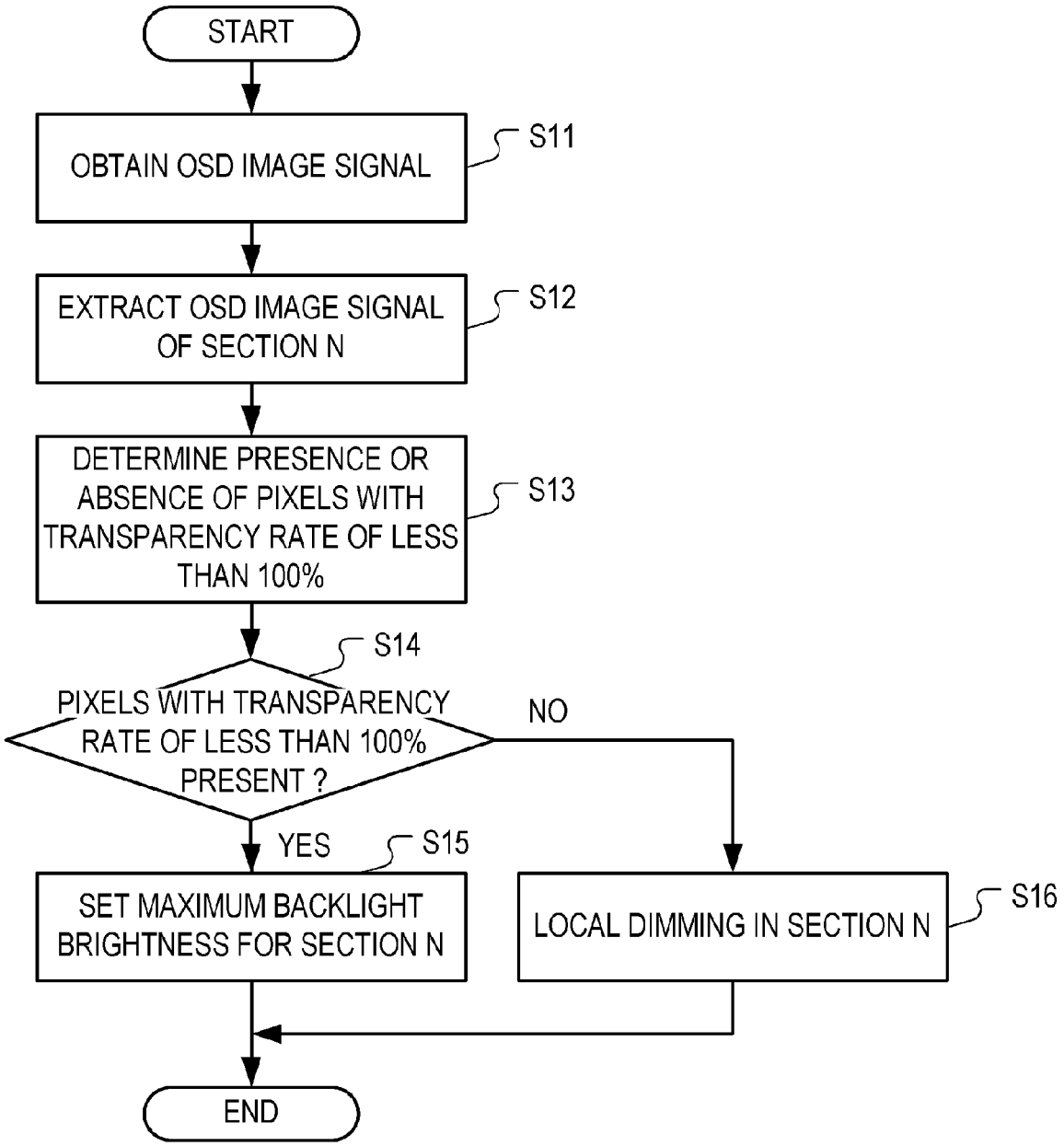
FIG. 3 is a flowchart illustrating one example of backlight control according to Embodiment 1.

Backlight control by the backlight control unit 102 will be described with reference to the flowchart of FIG. 3. The flowchart of FIG. 3 illustrates the backlight control of one divided section (divided section N in FIG. 2). The backlight control unit 102 performs the processing shown in the flowchart of FIG. 3 for all of the divided sections. The emission brightness of the backlight is thereby made uniform in a plurality of divided sections that contain an OSD image display region, while the backlight brightness of other divided sections is controlled based on the input image signal.

Figure 4:
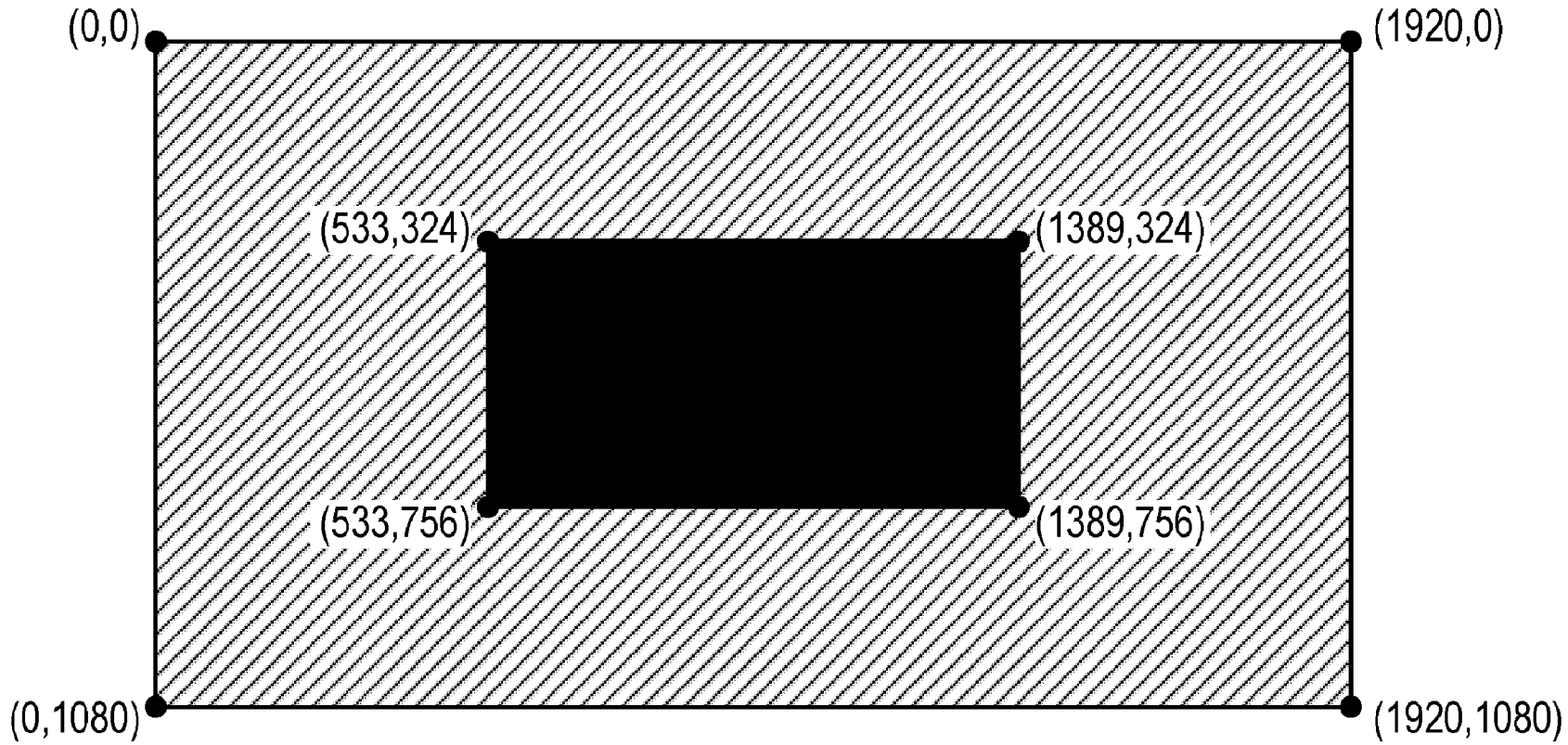
FIG. 4 is a diagram illustrating one example of an OSD image signal.

First, at step S11, the backlight control unit 102 obtains a signal for an image shown in FIG. 4 as an OSD image signal from the OSD image generating unit 105. The OSD image signal obtained at step S11 represents an image of the same size as that of the screen. The OSD image signal obtained at step S11 includes RGB (red, green, and blue) color signals and a signal indicative of transparency for each pixel. Here, transparency refers to the transparency of the image represented by the OSD image signal. Namely, an image in a region with a transparency rate of 100% in the image represented by the OSD image signal will not be displayed when overlapped on the image represented by the input image signal (image based on the input image signal corrected by the image signal correction unit 103). An image in a region with a transparency rate of less than 100% will be synthesized at a synthesis ratio in accordance with the transparency rate and displayed when overlapped on the image represented by the input image signal (with a transparency rate of 70%, the synthesis ratio between the input image signal and the OSD image signal will be 70:30). The hatched area in FIG. 4 indicates a region with a transparency rate of 100%, while the black area represents a region with a transparency rate of less than 100%. In this embodiment, images with a transparency rate of less than 100% are referred to as OSD images, and images with a transparency rate of 100% are not referred to as OSD images. However, the reference value for defining an OSD image may be set freely, i.e., images with a transparency rate of less than 50% for example may be defined as OSD images. The term "blending ratio $\alpha$", which indicates the proportion of the OSD image signal to be blended with the input image signal, may be used instead of the term "transparency rate" as used in this embodiment. Here, the "blending ratio $\alpha$" is equal to 100—"transparency rate". Image signals are not limited to RGB signals. They may be YCbCr signals, for example.

Figure 5A:
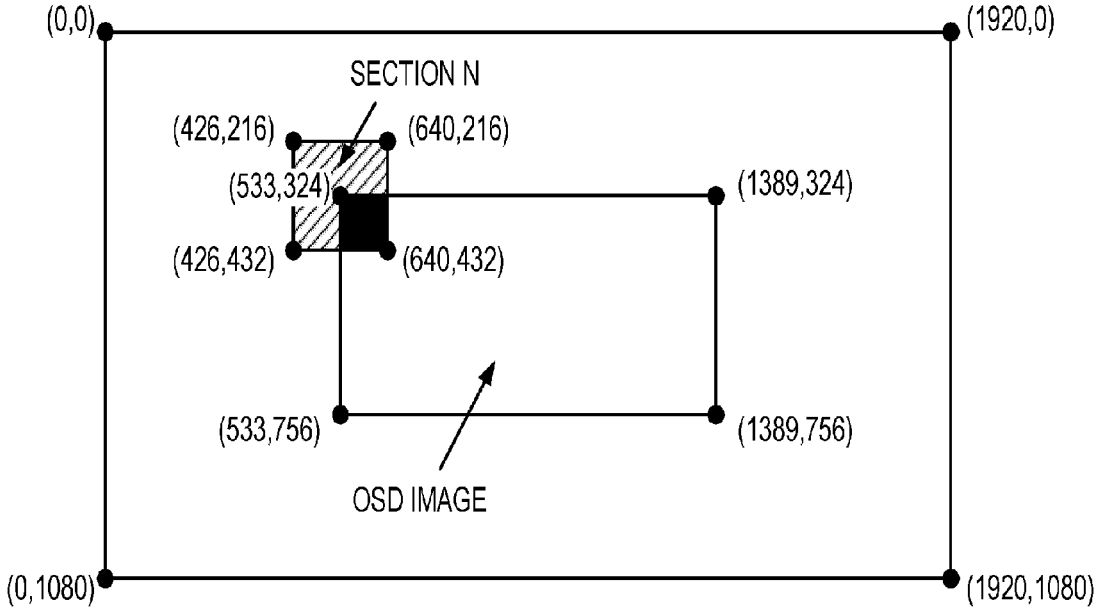
FIG. 5A and FIG. 5B are diagrams illustrating examples of image signals extracted at step S12 in FIG. 3.
Figure 5B:
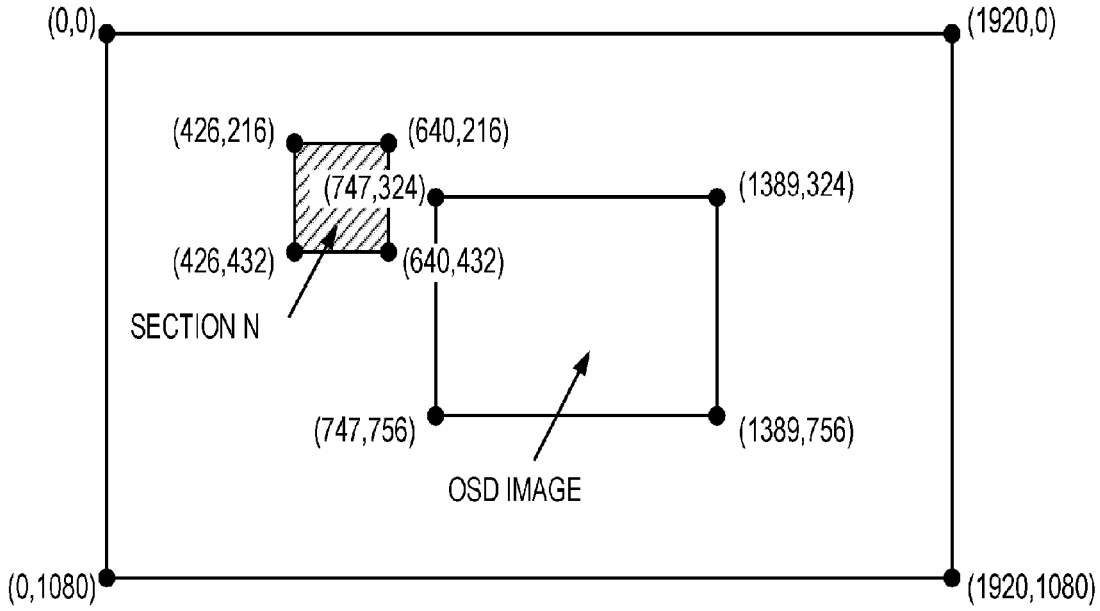

Next, at step S12, the backlight control unit 102 extracts an image signal for the divided section N from the OSD image signal obtained at step S11. FIG. 5A and FIG. 5B are diagrams illustrating examples of image signals extracted at step S12. The hatched areas in FIG. 5A and FIG. 5B indicate regions with a transparency rate of 100%, while the black area represents a region with a transparency rate of less than 100% (OSD image region). FIG. 5A is a diagram illustrating an image signal extracted as an OSD image signal for the divided section N shown in FIG. 2 when the OSD image signal is an image signal representing the OSD image shown in FIG. 4. In the example of FIG. 5A, the extracted OSD image signal contains an OSD image signal with a transparency rate of 100% and an OSD image signal with a transparency rate of less than 100%. FIG. 5B is a diagram illustrating an image signal extracted as an OSD image signal for the divided section N shown in FIG. 2 when the OSD image signal is an image signal representing a different OSD image from the one shown in FIG. 4. In the example of FIG. 5B, the extracted OSD image signal contains only an OSD image signal with a transparency rate of 100% and does not contain an OSD image signal with a transparency rate of less than 100%.

At step S13, the backlight control unit 102 determines whether or not the divided section N contains an OSD image display region. More specifically, the backlight control unit 102 analyzes the image signal extracted at step S12, and determines whether or not this image signal contains data of pixels with a transparency rate of less than 100%. In the example of FIG. 5A, it is determined that the signal contains data of pixels with a transparency rate of less than 100%. Namely, it is determined that the divided section N contains an OSD image display region. In the example of FIG. 5B, it is determined that the signal does not contain data of pixels with a transparency rate of less than 100%. Namely, it is determined that the divided section N does not contain an OSD image display region.

Next, if the backlight control unit 102 determines that the signal contains data of pixels with a transparency rate of less than 100% (the divided section N contains an OSD image display region) at step S13, the backlight control unit proceeds with the process to step S15 at step S14. If the backlight control unit 102 determines that the signal does not contain data of pixels with a transparency rate of less than 100% (the divided section N does not contain an OSD image display region) at step S13, the backlight control unit proceeds with the process to step S16.

At step S15, the backlight control unit 102 sets the backlight brightness of the divided section N to a maximum value.

At step S16, the backlight control unit 102 controls the backlight brightness of the divided section N based on the input image signal. Namely, the backlight control unit 102 performs local dimming backlight control for the divided section N. More specifically, the backlight control unit 102 extracts an image signal of the divided section N from the image signal input from the image signal input unit 101 and analyzes the brightness of the extracted image signal. If the image signal of the divided section N contains data of a large number of high-brightness pixels, the backlight control unit 102 increases the emission brightness of the backlight, while, if the image signal contains data of a large number of low-brightness pixels, the backlight control unit 102 reduces the emission brightness of the backlight.

The backlight brightness is controlled for each divided section in this manner based on the input image signal so that the contrast ratio can be improved.

Next, backlight control of Embodiment 1 will be described with a specific example.

Figure 6A:
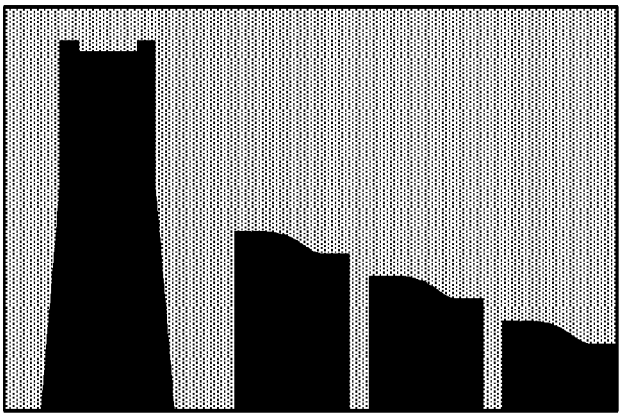
FIG. 6A to FIG. 6C are diagrams illustrating one example of the problem encountered by conventional techniques.
Figure 6B:
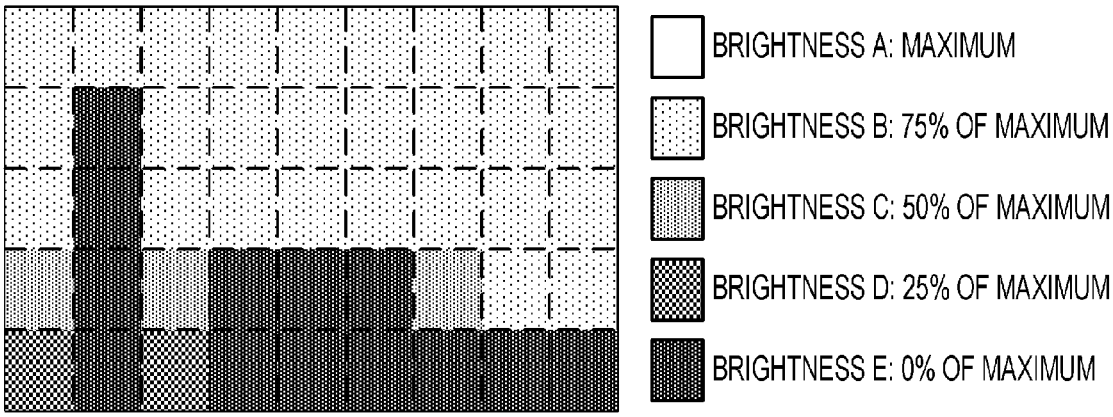

FIG. 6B is a diagram illustrating the emission brightness levels of the backlight of the respective divided sections when the image shown in FIG. 6A is displayed with the local dimming control.

Figure 6C:
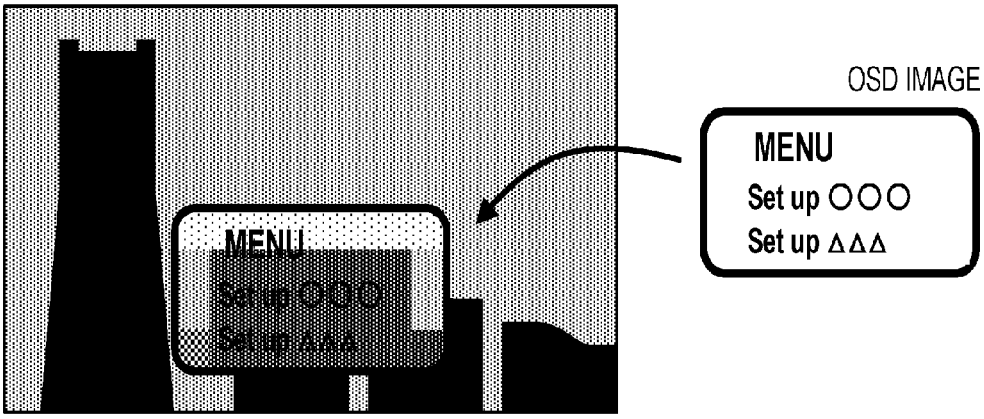

In FIG. 6B, brightness A is the highest value of brightness (maximum value), and brightness B, brightness C, brightness D, and brightness E (minimum value) are progressively lower in this order. More specifically, the ratio of brightness B to brightness A (ratio of brightness B to maximum brightness) is 75% (75:100), the ratio of brightness C to maximum brightness is 50% (50:100), the ratio of brightness D to maximum brightness is 25% (25:100), and the ratio of brightness E to maximum brightness is 0% (0:100). As shown in FIG. 6B, the backlight brightness of divided sections containing more dark areas of the image is made lower. Therefore, without the backlight control of Embodiment 1, the OSD image is displayed darker in divided sections with lower backlight brightness levels as shown in FIG. 6C, resulting in very poor visibility of the OSD image. The visibility of the OSD image is significantly lowered because of the variations in emission brightness among the plurality of divided sections containing OSD image display regions.

Figure 7A:
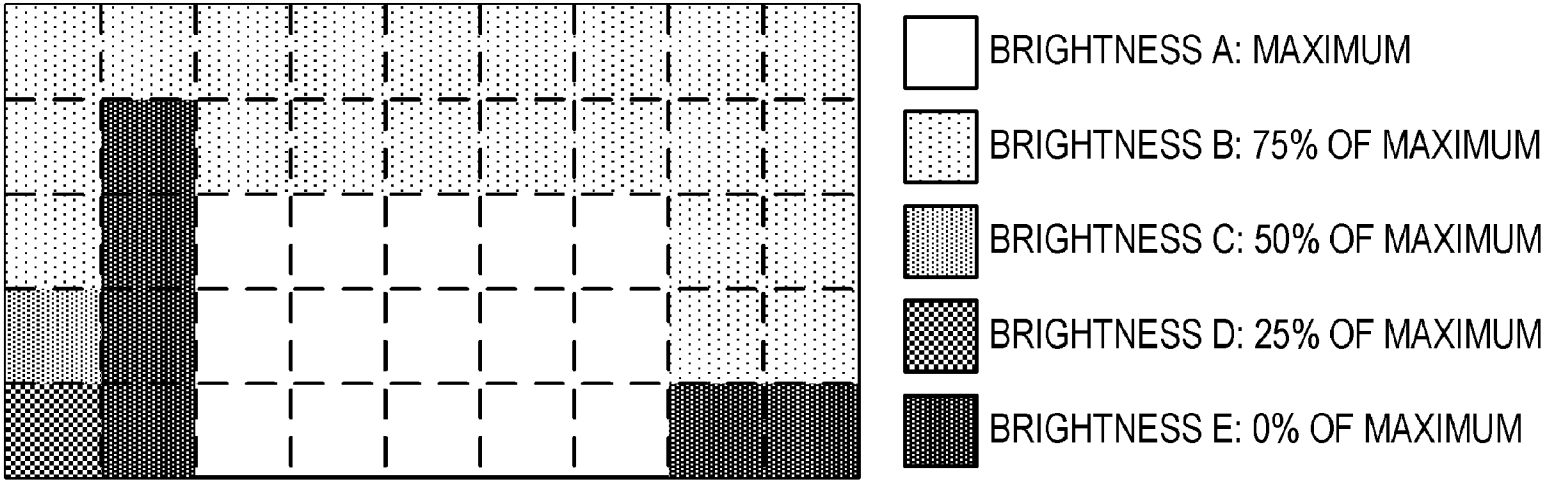
FIG. 7A and FIG. 7B are diagrams illustrating one example of effects of Embodiment 1.
Figure 7B:
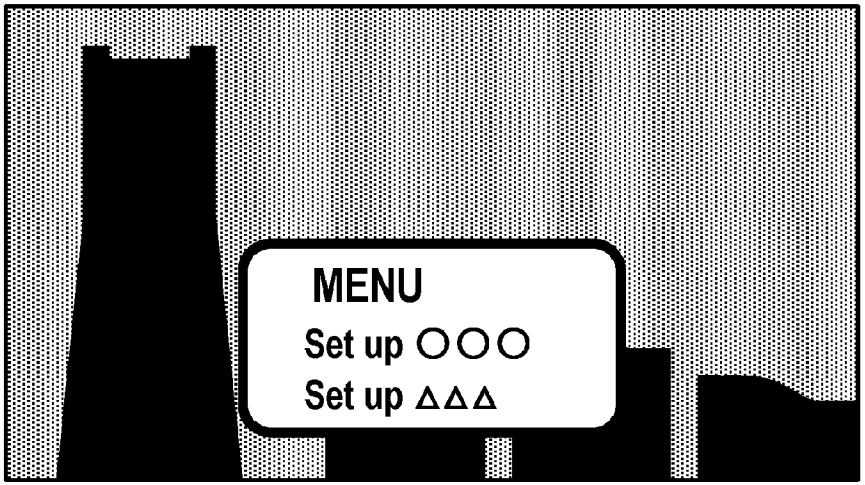

FIG. 7A illustrates the emission brightness levels of the backlight of the respective divided sections when the image of FIG. 6A is displayed with the OSD image of FIG. 6C overlapped thereon with the backlight control of Embodiment 1. FIG. 7B illustrates a display example of the image of FIG. 6A with the OSD image of FIG. 6C overlapped thereon with the emission brightness distribution of FIG. 7A.

In FIG. 7A, brightness A is the highest value of brightness (maximum value), and brightness B, brightness C, brightness D, and brightness E (minimum value) are progressively lower in this order. More specifically, the ratio of brightness B to maximum brightness is 75% (75:100), the ratio of brightness C to maximum brightness is 50% (50:100), the ratio of brightness D to maximum brightness is 25% (25:100), and the ratio of brightness E to maximum brightness is 0% (0:100). With the control of Embodiment 1 applied, the backlight brightness is made uniform in divided sections containing OSD image display regions, as shown in FIG. 7A. Namely, the local dimming backlight control is canceled in the divided sections containing the OSD image display regions. Therefore, the visibility of the OSD image is not lowered since there are no variations in emission brightness among the plurality of divided sections containing the OSD image display regions as shown in FIG. 7B. Since the display brightness of the OSD image is not lowered by local dimming, the visibility of the OSD image is enhanced as shown in FIG. 7B. Meanwhile, the backlight brightness is controlled by local dimming for divided sections other than those containing the OSD image display regions, as shown in FIG. 7A. Therefore, the high contrast effect by the local dimming can also be achieved.

Namely, the OSD image can be displayed with good visibility without compromising the advantage of higher contrast ratios achieved by the local dimming.

As described above, with the control of Embodiment 1, the backlight brightness is made uniform in a plurality of divided sections containing OSD image display regions, while the backlight brightness of other divided sections is controlled based on the input image signal. Thereby, the OSD image can be displayed with good visibility without compromising the advantage of higher contrast ratios achieved by the local dimming.

In this embodiment, further, the backlight brightness is set to a maximum value in divided sections containing OSD image display regions. This means that the display brightness of the OSD image can be maximized, leading to even better visibility of the OSD image.

While the image overlapped on the image based on the input image signal is an OSD image in this embodiment, the overlapped image is not necessarily limited to OSD images. For example, the overlapped image may be an image based on an image signal transmitted in data broadcasting or the like. It may be any image, as long as it is not the image based on the input image signal. In this embodiment, these overlapped images are referred to as "graphic images".

While the image signal correction unit 103 corrects the input image signal, and the image synthesis unit 106 synthesizes the corrected input image signal with the OSD image signal (graphic image signal) in this embodiment, the invention is not limited to this configuration. The image synthesis unit 106 may synthesize the input image signal before the correction with the graphic image signal to generate a synthetic image signal, and the image signal correction unit 103 may then correct this synthetic image signal. With such a configuration, changes in the display brightness of the OSD image resulting from the changes in the backlight brightness can be compensated for, so that the graphic image can be displayed with a display brightness closer to a desired level.

While the backlight brightness is set to a maximum value in a plurality of divided sections containing graphic image display regions in this embodiment, the emission brightness need not necessarily be set to a maximum level. The visibility of the graphic image can be improved by making the backlight brightness uniform in the plurality of divided sections containing graphic image display regions, irrespective of the brightness level. More specifically, the visibility of the graphic image will not be lowered since there are no variations in emission brightness among the plurality of divided sections containing the graphic image display regions. Alternatively, the backlight brightness of a plurality of divided sections containing graphic image display regions may be set higher than the maximum brightness level of this graphic image. By performing the correcting process at the image signal correction unit 103 in such a configuration, the graphic image can be displayed with a display brightness closer to a desired level.

While the OSD image signal (graphic image signal) represents an image of the same size as that of the screen in this embodiment, the graphic image signal is not necessarily limited to such a signal. The graphic image signal may be any signal that represents a graphic image. For example, the graphic image signal may be information including values for respective pixels and information indicative of the display region of the graphic image. The information indicative of the display region of the graphic image may be, for example, the size and display position of the graphic image, position coordinates of a start point (e.g., upper left corner) and an end point (e.g., lower right corner) of the display region, or the like.

Embodiment 2

Hereinafter, a liquid crystal display apparatus according to Embodiment 2 of the present invention and a control method thereof will be described. In Embodiment 2, the emission brightness of the backlight of each divided section is controlled based on the proportion of size of a graphic image display region contained in the divided section to the size of that divided section. The liquid crystal display apparatus 100 according to Embodiment 2 has the same configuration as that of Embodiment 1 and will not be described again. In the example described below, the graphic image is an OSD image.

Figure 8:
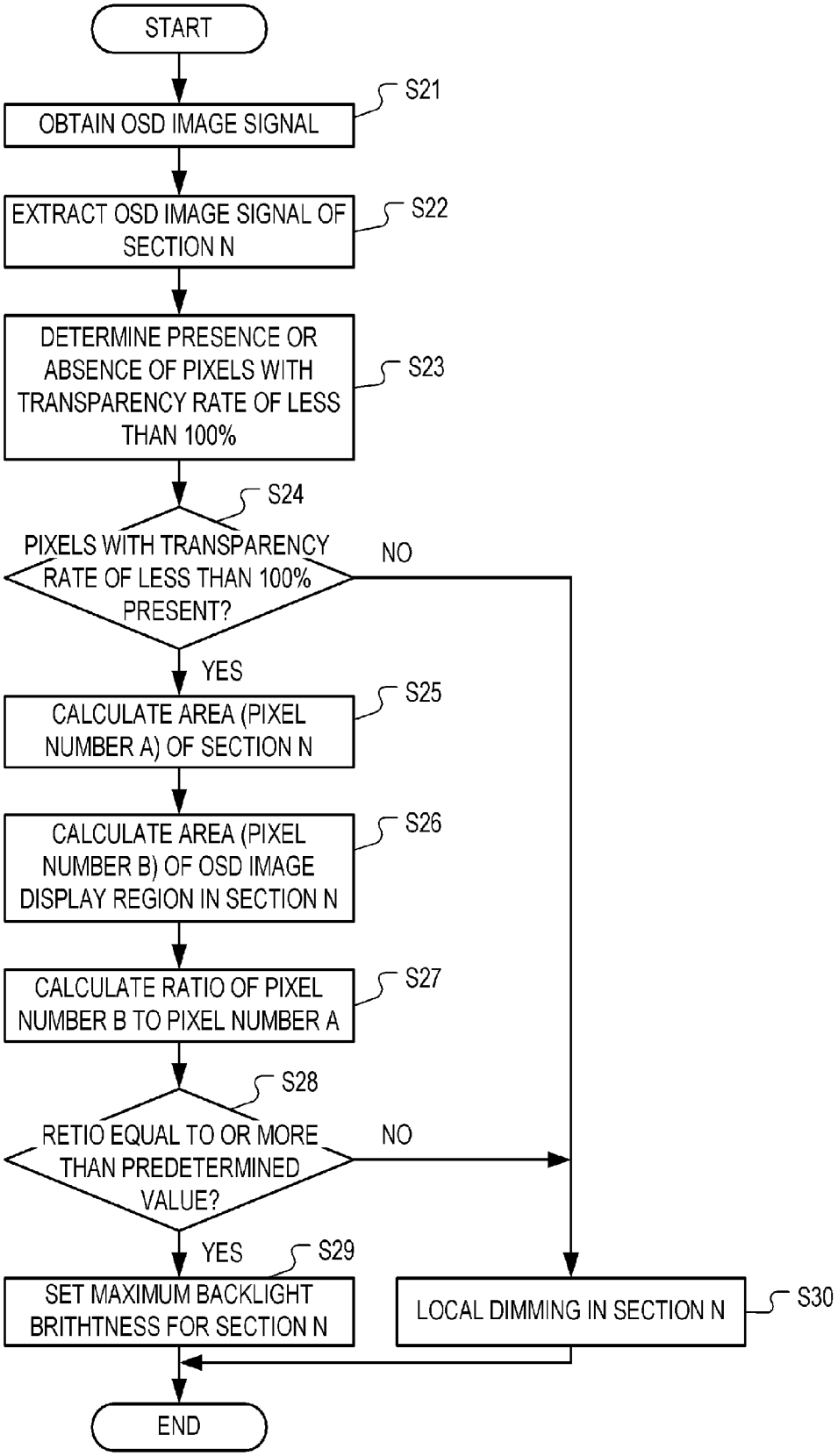
FIG. 8 is a flowchart illustrating one example of backlight control according to Embodiment 2.

Backlight control by the backlight control unit 102 will be described with reference to the flowchart of FIG. 8. The flowchart of FIG. 8 illustrates the backlight control of one divided section (divided section N in FIG. 2). The backlight control unit 102 performs the processing shown in the flowchart of FIG. 8 for all of the divided sections. Thereby, the backlight brightness is made uniform in a plurality of divided sections with a certain proportion or more of size of an OSD image display region contained in a divided section to the size of that divided section. The backlight brightness of other divided sections is controlled based on the input image signal.

The processing from step S21 to step S23 is the same as that from step S11 to step S13 in FIG. 3, and will not be described again.

Following step S23, if the backlight control unit 102 determines that the divided section N contains an OSD image display region at step S23, the backlight control unit proceeds with the process to step S25 at step S24, while, if not, the backlight control unit proceeds with the process to step S30.

At step S25, the backlight control unit 102 calculates the size of the divided section N. More specifically, the backlight control unit 102 calculates (counts) the number of pixels A of the image represented by the image signal extracted at step S22. In the example of FIG. 5A, the size of the divided section N is calculated as: $(640-426)\times(432-216)=46224$. Alternatively, the size of the divided section may preliminarily be stored in the apparatus.

Next, at step S26, the backlight control unit 102 calculates the size of the OSD image display region contained in the divided section N. More specifically, the backlight control unit 102 calculates (counts) the number of pixels B of the OSD image (i.e., image with a transparency rate of less than 100%) in the image represented by the image signal extracted at step S22. In the example of FIG. 5A, the size of the OSD image display region contained in the divided section N is calculated as: $(640-533)\times(432-324)=11556$.

Then, at step S27, the backlight control unit 102 calculates the proportion of size of the OSD image display region contained in the divided section N to the size of the divided section N. More specifically, the backlight control unit 102 calculates the ratio of the pixel number B calculated at step S26 to the pixel number A calculated at step S25. In the example of FIG. 5A, the ratio of size of the OSD image display region contained in the divided section N to the size of the divided section N is 11556/46224, hence 25% when multiplied by 100.

Next, at step S28, the backlight control unit 102 determines whether or not the proportion calculated at S27 is equal to or more than a predetermined value. If the backlight control unit 102 determines that the proportion calculated at S27 is equal to or more than the predetermined value, the process goes to step S29, while, if it is lower than the predetermined value, the process goes to step S30. In this embodiment, the predetermined value is 30%. In the example of FIG. 5A, since the proportion of size of the OSD image display region contained in the divided section N to the size of the divided section N is 25%, it is determined to be less than the predetermined value, and the process goes to step S30. Not to mention, the predetermined value need not necessarily be 30%. The predetermined value may be any value such as, for example, 20%, 50%, or 80%. Such predetermined value may preliminarily be set by the manufacturer, or it may be set (changed) by the user.

The processing at steps S29 and S39 is the same as that at steps S15 and S16 in FIG. 3, and will not be described again.

Next, backlight control of Embodiment 2 will be described with a specific example.

Figure 9A:
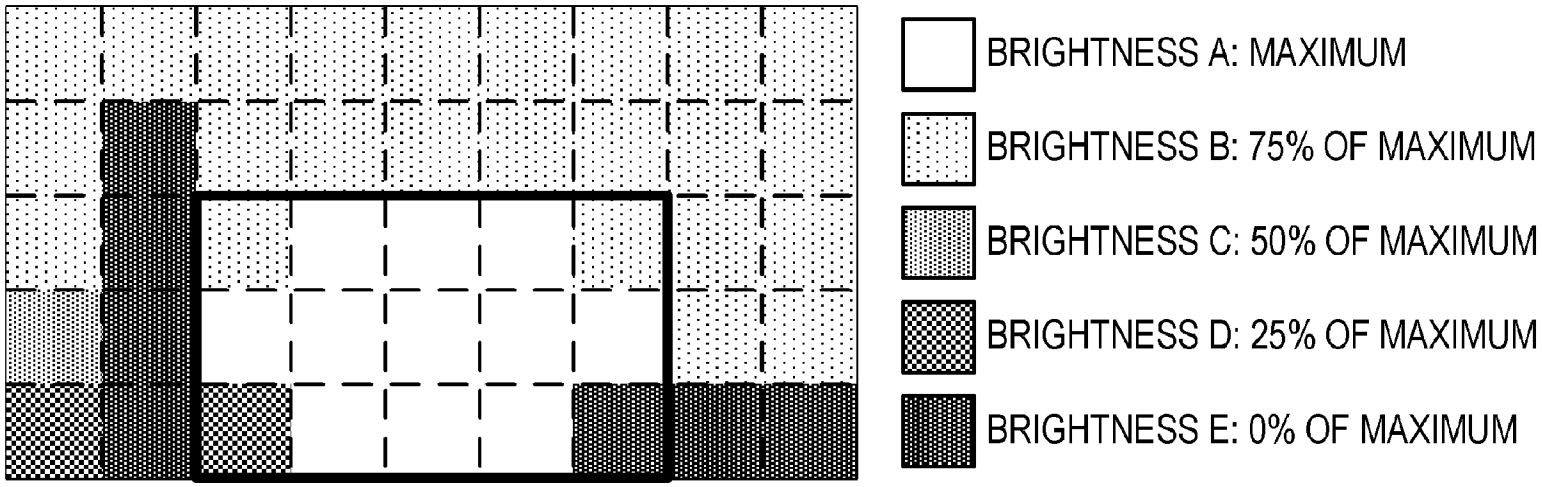
FIG. 9A and FIG. 9B are diagrams illustrating one example of effects of Embodiment 2.
Figure 9B:
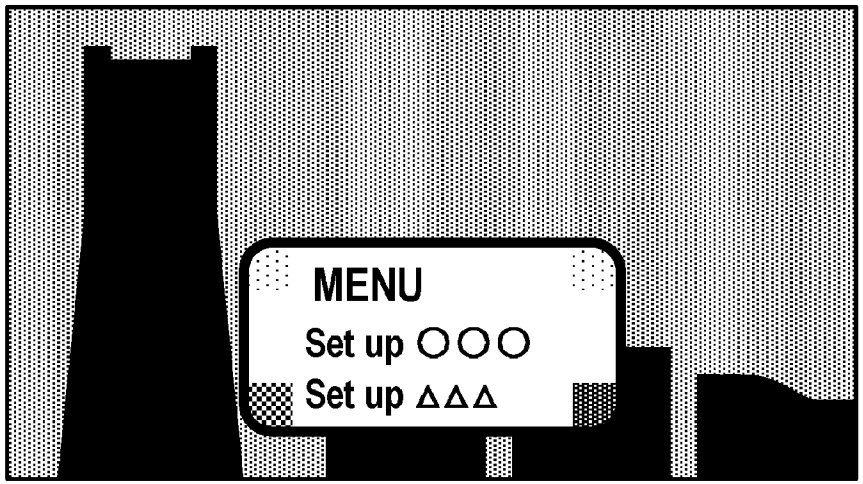

FIG. 9A illustrates the emission brightness levels of the backlight of the respective divided sections when the image of FIG. 6A is displayed with the OSD image of FIG. 6C overlapped thereon with the backlight control of Embodiment 2. FIG. 9B illustrates a display example of the image of FIG. 6A with the OSD image of FIG. 6C overlapped thereon with the emission brightness distribution of FIG. 9A.

In FIG. 9A, brightness A is the highest value of brightness (maximum value), and brightness B, brightness C, brightness D, and brightness E (minimum value) are progressively lower in this order. More specifically, the ratio of brightness B to brightness A (ratio of brightness B to maximum brightness) is 75% (75:100), the ratio of brightness C to maximum brightness is 50% (50:100), the ratio of brightness D to maximum brightness is 25% (25:100), and the ratio of brightness E to maximum brightness is 0% (0:100). The plurality of divided sections enclosed by the bold line in FIG. 9A are divided sections containing OSD image display regions. Of the plurality of divided sections enclosed by the bold line in FIG. 9A, those positioned at four corners have a proportion of size of the OSD image display region contained in the divided section to the size of the section of less than the predetermined value. Therefore, the backlight brightness of these divided sections is controlled based on the input image signal. In other words, the local dimming backlight control is activated for these divided sections. Similarly to Embodiment 1, the local dimming backlight control is activated for the divided sections that do not contain an OSD image display region.

Therefore, the area where local dimming is applied is wider in Embodiment 2 than in Embodiment 1, so that even a higher contrast ratio can be achieved.

The backlight brightness of the divided sections other than those positioned at four corners of the plurality of divided sections enclosed by the bold line in FIG. 9A is made uniform (set to a maximum value).

In this embodiment, as described above, the local dimming is activated for the divided sections with a proportion of size of an OSD image display region contained in a divided section to the size of that divided section of less than a predetermined value. For this reason, part of the OSD image (four corners of the OSD image in the example of FIG. 9B) may sometimes be displayed darker (or brighter) than other parts of the OSD image as shown in FIG. 9B. However, since the divided sections where the local dimming is activated contain only a small proportion of display regions of the OSD image, the visibility of the OSD image is hardly affected by the local dimming. Thus the OSD image can be displayed with good visibility with the configuration of this embodiment.

As described above, with this embodiment, the emission brightness of the backlight is made uniform in a plurality of divided sections with a certain proportion or more of size of a graphic image display region contained in a divided section to the size of the divided section. The backlight brightness of other divided sections is controlled based on the input image signal. Thereby, the graphic image can be displayed with good visibility without compromising the advantage of higher contrast ratios achieved by the local dimming. As compared to Embodiment 1, the area where local dimming is applied can be made wider, so that even a higher contrast ratio can be achieved.

Embodiment 3

Hereinafter, a liquid crystal display apparatus according to Embodiment 3 of the present invention and a control method thereof will be described. In Embodiment 3, the emission brightness of the backlight of each divided section is controlled based on whether or not the graphic image display region contained in the divided section has a higher brightness level than the backlight brightness based on the input image signal. Here, the backlight brightness based on the input image signal refers to an emission brightness level determined by local dimming. The liquid crystal display apparatus 100 according to Embodiment 3 has the same configuration as that of Embodiment 1 and will not be described again. In the example described below, the graphic image is an OSD image.

Figure 10:
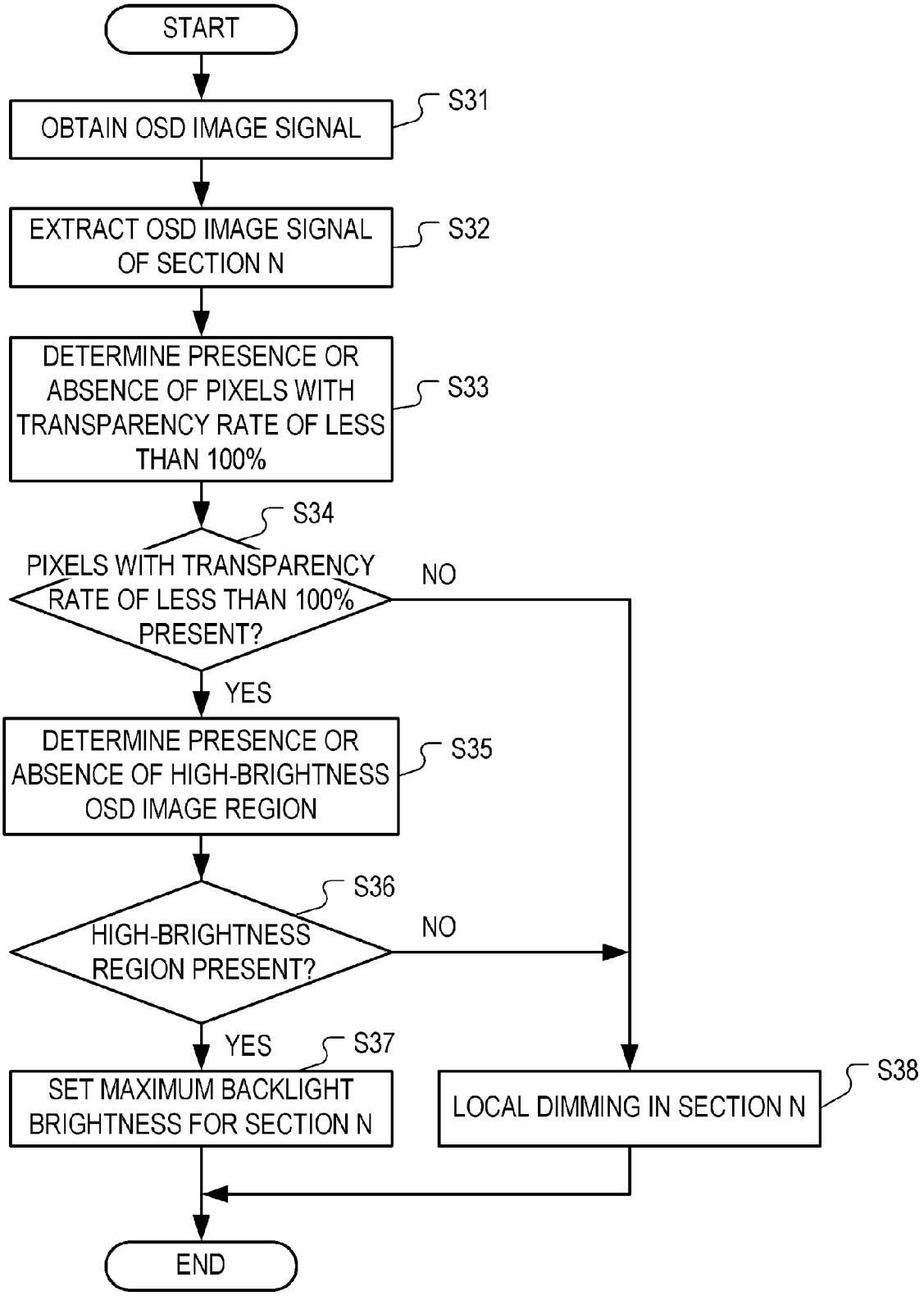
FIG. 10 is a flowchart illustrating one example of backlight control according to Embodiment 3.

Backlight control by the backlight control unit 102 will be described with reference to the flowchart of FIG. 10. The flowchart of FIG. 10 illustrates the backlight control of one divided section (divided section in FIG. 2). The backlight control unit 102 performs the processing shown in the flowchart of FIG. 10 for all of the divided sections. Thereby, the backlight brightness of a plurality of divided sections containing graphic image display regions with a higher brightness level than the backlight brightness based on the input image signal is made uniform. The backlight brightness of other divided sections is controlled based on the input image signal.

The processing from step S31 to step S33 is the same as that from step S11 to step S13 in FIG. 3, and will not be described again.

Following step S33, if the backlight control unit 102 determines that the divided section N contains an OSD image display region at step S33, the process goes to step S35 at step S34, while, if not, the process goes to step S38.

At step S35, the backlight control unit 102 calculates the backlight brightness of the divided section N based on the input image signal. Namely, the backlight brightness of the divided section N for performing local dimming backlight control (emission brightness for local dimming) is calculated. The backlight control unit 102 analyzes the image signal extracted at step S32, and determines whether or not the divided section N contains an OSD image display region with a higher brightness level than the emission brightness for local dimming thus calculated (high-brightness OSD image region). More specifically, the backlight control unit 102 calculates the respective brightness levels of pixels of the OSD image (i.e., image with a transparency rate of less than 100%) represented by the image signal extracted at step S32. The backlight control unit 102 then determines, based on the calculated brightness levels of the pixels, whether or not there are pixels with a higher brightness level than the emission brightness for local dimming calculated as noted above. The brightness Y of an OSD image pixel is calculated by the following equation, for example, from the color signals (RGB values) of the respective pixel contained in the OSD image signal:

$$Y=0.29891R+0.58661G+0.11448B.$$

Next, if the backlight control unit 102 determines at step S35 that the divided section N contains a high-brightness OSD image region, the backlight control unit proceeds with the process to step S37 at step S36. If the backlight control unit 102 determines at step S35 that the divided section N does not contain a high-brightness OSD image region, the backlight control unit proceeds with the process to step S38.

The processing at steps S37 and S38 is the same as that at steps S15 and S16 in FIG. 3, and will not be described again.

Next, backlight control of Embodiment 3 will be described with a specific example.

Figure 11A:
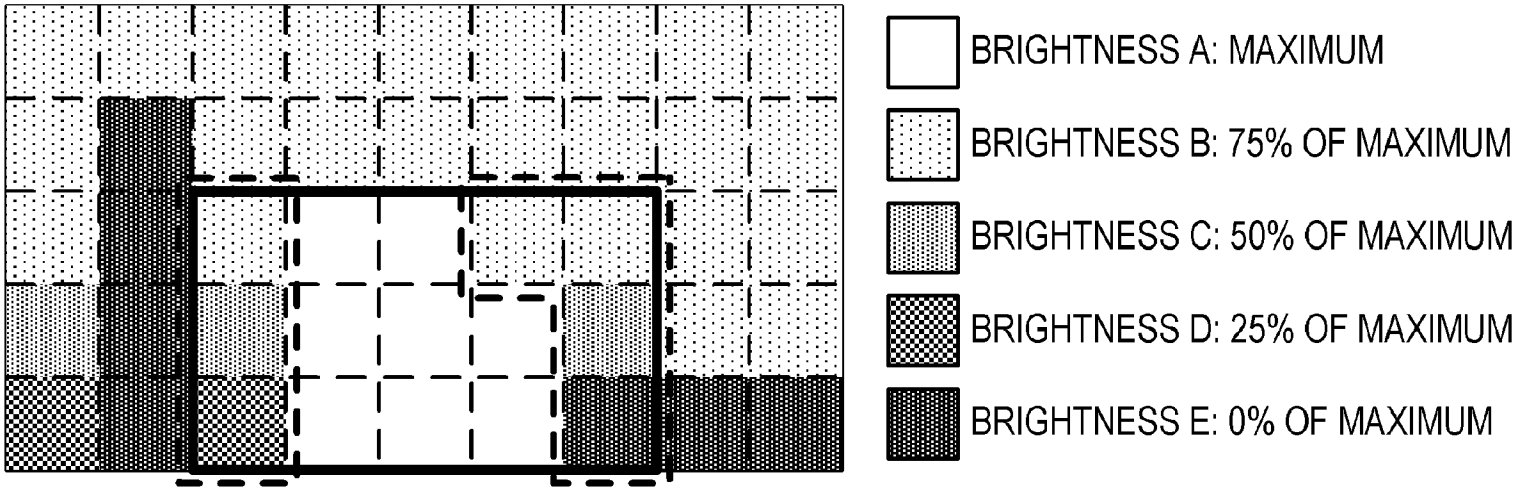
FIG. 11A and FIG. 11B are diagrams illustrating one example of effects of Embodiment 3.
Figure 11B:
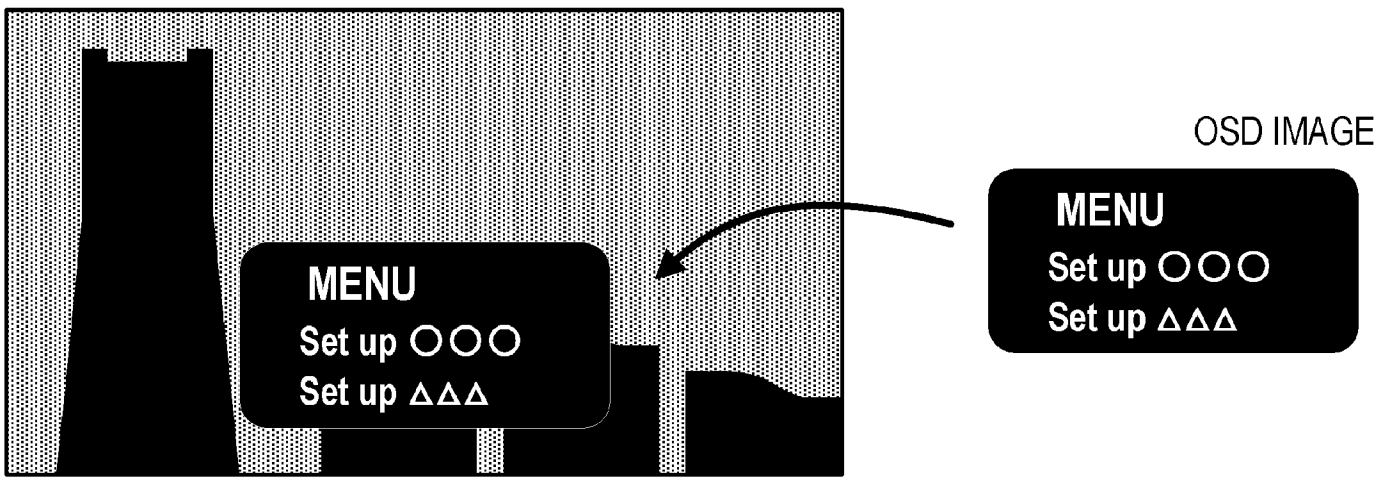

FIG. 11A illustrates the emission brightness levels of the backlight of the respective divided sections when the image of FIG. 6A is displayed with the OSD image of FIG. 11B overlapped thereon with the backlight control of Embodiment 3. The OSD image shown in FIG. 11B is an image in which pixels forming the background have a low brightness, while pixels forming other features (for example, characters) have a high brightness. FIG. 11B illustrates a display example of the image of FIG. 6A with this OSD image overlapped thereon with the emission brightness distribution of FIG. 11A.

In FIG. 11A, brightness A is the highest value of brightness (maximum value), and brightness B, brightness C, brightness D, and brightness E (minimum value) are progressively lower in this order. More specifically, the ratio of brightness B to brightness A (ratio of brightness B to maximum brightness) is 75% (75:100), the ratio of brightness C to maximum brightness is 50% (50:100), the ratio of brightness D to maximum brightness is 25% (25:100), and the ratio of brightness E to maximum brightness is 0% (0:100). The plurality of divided sections enclosed by the bold line in FIG. 11A are divided sections containing OSD image display regions. Of the plurality of divided sections enclosed by the bold line in FIG. 11A, the divided sections enclosed by the bold broken line are divided sections that do not contain OSD image display regions with a higher brightness level than the emission brightness for local dimming. Therefore, the backlight brightness of these divided sections is controlled based on the input image signal. In other words, the local dimming backlight control is activated for these divided sections. Similarly to Embodiment 1, the local dimming backlight control is activated for the divided sections that do not contain OSD image display regions.

Therefore, the area where local dimming is applied is wider in Embodiment 3 than in Embodiment 1, so that even a higher contrast ratio can be achieved.

The emission brightness of the backlight is made uniform (set to a maximum value) in the divided sections not enclosed by the bold broken line, of the plurality of divided sections enclosed by the bold line in FIG. 11A.

As described above, in this embodiment, the local dimming is activated for divided sections that do not contain OSD image display regions with a higher brightness level than the emission brightness for local dimming. For this reason, part of the OSD image (low-brightness region) may sometimes be displayed darker (or brighter) than other parts of the OSD image. However, the OSD image is very likely to contain a high-brightness region in the area where good visibility is desired. Therefore, even though the low-brightness area of the OSD image is displayed darker (or brighter) than other areas of the OSD image by local dimming, the visibility of the OSD image is hardly affected so that the OSD image can be displayed with good visibility as shown in FIG. 11B.

In this embodiment, the divided sections where the local dimming is activated contain only the OSD image display regions with a brightness not higher than the emission brightness for local dimming. Therefore, the apparatus should preferably be configured such that the image synthesis unit 106 synthesizes the input image signal before the correction with the graphic image signal to generate a synthetic image signal, and the image signal correction unit 103 corrects this synthetic image signal. With this configuration, changes in the display brightness of the OSD image resulting from the changes in the emission brightness of the backlight can be compensated for by the processing at the image signal correction unit 103, so that the entire OSD image can be displayed with a display brightness closer to a desired level.

As described above, in this embodiment, the backlight brightness is made uniform in a plurality of divided sections containing graphic image display regions with a higher brightness level than the backlight brightness based on the input image signal. The backlight brightness of other divided sections is controlled based on the input image signal. Thereby, the graphic image can be displayed with good visibility without compromising the advantage of higher contrast ratios achieved by the local dimming. As compared to Embodiment 1, the area where local dimming is applied can be made wider, so that even a higher contrast ratio can be achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-113884, filed on May 20, 2011, which is hereby incorporated by reference herein in its entirety.

What is claimed is:

1. A display apparatus comprising:

a display panel;

a backlight having emission brightness levels adjustable for each of a plurality of divided sections;

a graphic image generator that generates a graphic image signal;

a synthesizer that generates a synthetic image signal representing a synthetic image in which a graphic image based on the graphic image signal is overlapped on an input image based on an input image signal; and a controller that controls the emission brightness levels of the backlight for each of the divided sections on the basis of the input image signal and the graphic image signal, wherein the controller determines, for each of divided sections, a proportion of size of a graphic image display region contained in the divided section relative to the size of the divided section, the graphic image display region being a region where the graphic image is displayed, the controller obtains brightness characteristic value of the input image data corresponding to each divided section, of which the proportion is smaller than a predetermined value, and the controller controls the emission brightness levels of the backlight of a plurality of divided sections, of which the portion is not smaller than the redetermined value, to be uniform, and controls the emission brightness level of the backlight of each divided section, of which the proportion is smaller than the predetermined value, on the basis of the brightness characteristic value of the input image signal.

2. The display apparatus according to claim 1, wherein the controller sets the emission brightness levels of the backlight of a plurality of divided sections, of which the proportion is not smaller than the predetermined value, higher than a maximum brightness level of the graphic image.

3. The display apparatus according to claim 1, wherein the controller sets the emission brightness levels of the backlight of a plurality of divided sections, of which the proportion is not smaller than the predetermined value, to a maximum value.

4. The display apparatus according to claim 1, wherein the graphic image display region is a region where a graphic image having a transparency of less than a predetermined transparency rate is displayed.

5. A method of controlling a display apparatus including a display panel and a backlight having emission brightness levels adjustable for each of a plurality of divided sections, the method comprising:

a graphic image generating step of generating a graphic image signal;

a synthetic image generating step of generating a synthetic image signal representing a synthetic image in which a graphic image based on the graphic image signal is overlapped on an input image based on an input image signal; and a control step of controlling the emission brightness levels of the backlight for each of the divided sections on the basis of the input image signal and the graphic image signal, wherein in the control step, for each of divided sections, a proportion of size of a graphic image display region contained in the divided section relative to the size of the divided section is determined, the graphic image display region being a region where the graphic image is displayed, brightness characteristic value of the input image data corresponding to each divided section, of which the proportion is smaller than a predetermined value, is obtained, the emission brightness levels of the backlight of a plurality of divided sections, of which the proportion is not smaller than the predetermined value, are controlled to be uniform, and the emission brightness level of the backlight of each divided section, of which the proportion is smaller than the predetermined value, is controlled on the basis of the brightness characteristic value of the input image signal.

* * * * *